United States Patent [19]

Wilsberg et al.

[11] Patent Number: 4,877,556

[45] Date of Patent: Oct. 31, 1989

[54] CLEANING COMPOSITIONS CONTAINING AN ALCOHOL AND FATTY ACID ESTER AND THEIR USE IN THE PRETREATMENT OF FABRICS

[75] Inventors: Heinz-Manfred Wilsberg, Cologne; Rolf Puchta, Haan, both of Fed. Rep. of Germany

[73] Assignee: Henkel Kommanditgesellschaft auf Aktien, Duesseldorf, Fed. Rep. of Germany

[21] Appl. No.: 274,634

[22] Filed: Nov. 15, 1988

Related U.S. Application Data

[63] Continuation of Ser. No. 80,118, Jul. 31, 1987, abandoned.

[30] Foreign Application Priority Data

Aug. 2, 1986 [DE] Fed. Rep. of Germany ..... 3626224

[51] Int. Cl.[4] ..... C11D 1/44; C11D 1/875; C11D 3/43

[52] U.S. Cl. ..... 252/544; 252/548; 252/153; 252/170; 252/171; 252/174.21; 252/174.22; 252/DIG. 14; 252/DIG. 19

[58] Field of Search ..... 252/174.21, 174.22, 252/170, 171, 544, 548, DIG. 14, DIG. 19, 153

[56] References Cited

U.S. PATENT DOCUMENTS

| | | | |
|---|---|---|---|
| 2,867,585 | 1/1959 | Vitale | 252/135 |
| 3,619,119 | 11/1971 | Metzkausen | 8/137 |
| 3,625,909 | 12/1971 | Berg | 252/153 |
| 4,288,339 | 9/1981 | Wilsberg | 252/90 |
| 4,457,857 | 7/1984 | Sepulveda | 252/174.21 |
| 4,530,781 | 7/1985 | Gipp | 252/546 |
| 4,675,124 | 6/1987 | Seiter | 252/91 |
| 4,801,544 | 1/1989 | Munk | 252/174.12 X |

FOREIGN PATENT DOCUMENTS

| | | |
|---|---|---|
| 1792066 | 10/1971 | Fed. Rep. of Germany . |
| 2358822 | 6/1975 | Fed. Rep. of Germany . |
| 1518676 | 7/1978 | United Kingdom . |

OTHER PUBLICATIONS

Ash, M., *A Formulary of Detergents and Other Cleaning Agents*, N.Y., Chemical Publishing Co., 1980, pp. 9–11.

Schuelke, Arthur, *Modern Spotting for the Drycleaning Industry*, U.S., Reuben H. Donnelley Corp., 1961, p. 187.

*Primary Examiner*—Prince E. Willis

*Attorney, Agent, or Firm*—Ernest G. Szoke; Wayne C. Jaeschke; Henry E. Millson, Jr.

[57] ABSTRACT

A cleaning preparation containing from 2 to 40% by weight ethoxylated fatty alcohol and/or oxoalcohol and from 10 to 90% by weight of a fatty acid ester. In addition, the cleaning preparation may contain water, a monohydric alcohol and liquid hydrocarbons. The cleaning preparation is used for the pretreatment of heavily soiled fabrics before washing.

10 Claims, No Drawings

CLEANING COMPOSITIONS CONTAINING AN ALCOHOL AND FATTY ACID ESTER AND THEIR USE IN THE PRETREATMENT OF FABRICS

This application is a continuation of application Ser. No. 080,118 filed 7/31/87, now abandoned.

BACKGROUND OF THE INVENTION

1. Field of the Invention

This invention relates to cleaning preparations which are particularly suitable for the pretreatment and prespotting of fabrics and which do not contain any halogenated hydrocarbons.

2. Statement of Related Art

Heavy local soil cannot always be satisfactorily removed from fabrics by washing in a washing machine. The reason for this lies in particular in the increasing popularity of easy-care washable fabrics which, to retain their properties, must only be washed at low washing temperatures, such as for example 60° C. or only 30° C. Such soil types as oil, particularly used engine oil, or pigment soil and mixtures thereof, are among the most difficult household stains, particularly at low washing temperatures. In many cases, therefore, particularly heavily soiled areas of the fabrics have to be pretreated with a cleaning preparation before washing. The effect of known, commercial fabric pretreatment preparations is largely based on a high content of halogenated hydrocarbons (HHCS), such as for example methylene chloride or perchloroethylene, or fluorinated hydrocarbons. Because of their effect on the environment, however, HHCS are having to be replaced by environmentally compatible raw materials.

Known stain removers are unsatisfactory due to their content of biologically non-degradable alkylphenol ethoxylates and their relatively high content of chlorinated hydrocarbons.

Liquid cleaning preparations containing water and organic solvents are known from German Patent No. 1,792,066. The surfactants used are mixtures of various nonionic alcohol alkoxylates, of which the principal constituent is a biologically non-degradable ethylene oxide/propylene oxide block polymer. Due to their water content, these known preparations are not suitable for packing in internally non-lacquered aerosol cans susceptible to corrosion. In addition, they are largely ineffectual against many soil types.

U.S. Pat. No. 4,288,339 describes propellent-containing cleaning preparations intended for spraying which contain chlorinated hydrocarbons in addition to alcohols differing in their degree of ethoxylation and hydrocarbon mixtures. Many other known products are inflammable due to their composition.

STATEMENT OF THE INVENTION

Other than in the operating examples, or where otherwise indicated, all numbers expressing quantities of ingredients or reaction conditions used herein are to be understood as modified in all instances by the term "about".

An object of the present invention is to provide a cleaning preparation which, on the one hand, does not contain any HHCS and which, in addition, can be formulated to be non-inflammable. Further requirements which a product such as this has to satisfy are:

the surfactants used have to be sufficiently biodegradable;

the product must be able to be thoroughly rinsed out;

the product must lend itself to perfuming.

It has now surprisingly been found that the requirements stated above are satisfied by cleaning preparations which contain certain fatty acid esters in combination with certain nonionic surfactants.

The cleaning preparation of the invention is a cleaning preparation based on adducts of ethylene oxide with fatty alcohols and/or oxoalcohols, wherein the cleaning preparation contains (a) from 2 to 40% by weight of at least one fatty alcohol and/or oxoalcohol containing from 10 to 20 carbon atoms and from 1 to 10 moles ethylene oxide, (b) from 10 to 90% by weight of at least one fatty acid ester selected from isopropyl myristate, isopropyl palmitate, isopropyl stearate, oleyl oleate, hexyl laurate, di-n-butyl adipate, caprylic or capric acid esters of saturated $C_{12}$–$C_{18}$ fatty alcohols, esters of branched-chain $C_8$–$C_{12}$ fatty acids with $C_{14}$–$C_{20}$ fatty alcohols, decyl oleate, isooctyl stearate, glycerol trioleate, and i-butyl oleate.

Suitable ethoxylated fatty alcohols are compounds derived from synthetic or, more especially, natural alcohols or alcohol mixtures. Both saturated and unsaturated fatty alcohols, individually or in mixtures, may serve as starting materials. Oxoalcohols are synthetic alcohols containing varying amounts of 2-methyl-branched alcohols. In many cases, it may be appropriate to use combinations of fatty alcohol and/or oxoalcohol ethyoxylates which contain a different number of carbon atoms in the fatty alcohol component and/or have different degrees of ethoxylation in order to optimize the properties of the cleaning preparations of the invention. Cleaning preparations differing from one another in performance and properties can be prepared by appropriate selection of the components thereof.

In addition to the alcohol ethoxylate and the fatty acid ester, preferred cleaning preparations also contain water in quantities of from 0.1 to 50% by weight. Other preferred cleaning preparations contain from 1 to 50% by weight of a monohydric $C_1$–$C_4$ alcohol in addition to the alcohol ethoxylate and the fatty acid ester.

Particularly valuable properties are shown by products which in addition to the two compulsory constituents, contain from 3 to 15% by weight of a monohydric $C_1$–$C_4$ alcohol and from 0.5 to 40% by weight water.

If, as already mentioned, mixtures of different alcohol ethoxylates are used, combinations of from 2 to 30% by weight of alcohol ethoxylate containing from 5 to 10 moles of ethylene oxide and from 2 to 10% by weight of alcohol ethoxylate containing from 1 to 4 moles of ethylene oxide are of particular interest in terms of a high and balanced performance level. The alcohol having the lower degree of ethoxylation can be completely or partly replaced by a $C_{10}$–$C_{20}$ fatty amine containing from 1 to 4 moles of ethylene oxide.

Up to 90% by weight of the fatty acid ester or the fatty acid ester mixture can be replaced by aliphatic, straight-chain and/or branched liquid $C_6$–$C_{40}$ hydrocarbons or mixtures thereof. It is also possible in this way optimally to adapt the cleaning preparations according to the invention to a desired combination of properties.

Of the monohydric alcohols which can be used as part of the cleaning preparation of the invention, ethyl alcohol and/or isopropyl alcohol are particularly preferred. The alcohol content and the liquid hydrocarbon content affect the consistency, inflammability and cleaning effect of the preparation. Particularly preferred cleaning preparations contain a more or less large percentage of the specified components according to requirements.

In general, cleaning preparations having particularly balanced properties with respect to their cleaning effect both on pigment soil and on oily or fatty soil in various types of fabrics contain from 5 to 20% by weight $C_{10}$–$C_{20}$ fatty alcohol and/or oxoalcohol onto which from 5 to 10 moles of ethylene oxide have been added. Equally favorable properties are shown by a cleaning preparation containing from 3 to 7% by weight of $C_{10}$–$C_{20}$ fatty alcohol and/or oxoalcohol onto which from 1 to 4 moles ethylene oxide have been added. In many cases, particularly effective cleaning preparations contain both higher and lower ethoxylated alcohols of the above-disclosed type in the above-disclosed quantities. As stated above, in addition to or instead of the lower ethoxylated alcohol, the preparation can contain a $C_{10}$–$C_{20}$ fatty amine containing from 1 to 4 moles of ethylene oxide, which enhances its cleaning effect. In addition, perfumes can be added to the preparations.

Depending on its consistency, which may be varied within wide limits through selection of the constituents, the preparations of the invention can be applied to the soiled fabrics by spraying with or without a gaseous propellent, such as for example carbon dioxide or butane or propane, or alternatively can be applied in liquid or pasty or gel-like form. Accordingly, the present invention also relates to the use of the cleaning preparations described above for the pretreatment of heavily soiled fabrics.

The invention will be illustrated but not limited by the following examples.

EXAMPLES

The mode of action of cleaning preparations according to the invention differing in their composition is described in the following Examples. In these Examples, "EO" stands for added ethylene oxide. The percentages are percentages by weight.

Washing tests were carried out on white PES/cotton 50:50 fabrics. A commercial product, FAKT® was used as detergent in a concentration of 16.1 g/l at a temperature of 60° C.

The fabrics were soiled with (1) olive oil containing Sudan red, (2) used engine oil, (3) pigment soil dispersion.

The fabric was placed on a filter paper and 3 drops of a soil applied. After a contact time of 30 seconds, the fabric was placed in a screw-top glass container.

2 g of one of the cleaning preparations described further below were applied dropwise to the fabric and left thereon for 5 minutes. 75 ml of the detergent were then added and the container shaken 10 times. The fabric was then removed, rinsed in 500 ml tapwater (stirred 10 times) and dried on a filter paper.

Performance was evaluated by visual assessment of the stain removal by comparison with a non-pretreated fabric.

EXAMPLE 1

Cleaning preparations having the following general composition were prepared:

7.5% $C_{14}$–$C_{15}$ oxoalcohol+7 EO

5% $C_{18}$–$C_{13}$ cocosamine+2 EO

30% ethanol, anhydrous and 57.5% fatty acid ester.

The fatty acid esters used in the Examples were:

(a) decyl oleate, (b) the ester of isononanoic acid with $C_{14}$–$C_{20}$ fatty alcohols, (c) isopropyl myristate, (d) isopropyl stearate.

COMPARISON EXAMPLE 1

The fatty acid esters used in the formulation of Comparison Example 1 were (a) polyol fatty acid ester and (b) glycerol monooleate.

The formulations of Comparison Example 1 (a) and (b) show a distinctly poorer cleaning effect than the formulations of Examples 1 (a) to (d).

EXAMPLE 2

Formulations as in Examples 1 (a) to (d) using

40% ethanol, anhydrous and 47.5% fatty acid ester.

COMPARISON EXAMPLE 2

Formulation as in Example 2 using the fatty acid esters of Comparison Example 1.

The results of the washing tests correspond to those of Example 1 and Comparison Example 1.

EXAMPLE 3

Formulations as in Examples 1 (a) to (d) using 37.5% ethanol, anhydrous and

50% fatty acid ester.

The cleaning preparations also gave better results than those of Comparison Example 1 (a) and (b).

EXAMPLE 4

Cleaning preparations of the following composition were prepared:

7.5% $C_{14}$–$C_{15}$ oxoalcohol+7 EO

5% $C_8$–$C_{13}$ cocosamine+2 EO

5% ethanol, 99.9%

32.5% $C_{12}$ –$C_{14}$ isoparaffin mixture, boiling range 207°–251° C.

48.7% fatty acid ester 0.5% perfume and 0.8% water.

The fatty acid esters used in the Examples were:

(a) isooctyl stearate, (b) decyl oleate, (c) the ester of isononanoic acid and $C_{14}$–$C_{20}$ fatty alcohols (d) lauric acid hexyl ester and (e) isopropyl myristate.

EXAMPLE 5

A formulation corresponding to Example 4 was prepared using

10% ethanol, 99.9% and 27.5% isoparaffin mixture, boiling 207° to 251° C.

The cleaning preparations of Examples 4 and 5 showed a very good effect in the removal of stains of used engine oil.

EXAMPLE 6

A cleaning preparation corresponding in its composition to Example 1 (a) to 1 (d) was prepared using (a) 7.5% $C_{12}$–$C_{18}$ fatty alcohol+5 EO and (b) 7.5% of a fatty alcohol mixture.

EXAMPLE 7

A cleaning preparation corresponding in its composition to Examples 1 (a) to 1 (d) was prepared using (a) 5% oleyl cetyl alcohol+5 EO (b) 5% $C_{12}$–$C_{14}$ alcohol+3 EO (c) $C_{12}$–$C_{18}$ alcohol+4 EO.

The cleaning preparations of Examples 6 and 7 had an excellent cleaning effect.

We claim:

1. A cleaning composition consisting essentially of (a) from about 2 to about 30% by weight of at least one $C_{10}$–$C_{20}$ fatty alcohol and/or oxoalcohol wherein the fatty alcohol and oxoalcohol contain from 5 to 10 moles of ethylene oxide, (b) from about 10 to about 90% by weight of at least one fatty acid ester selected from the group consisting of isopropyl myristate, isopropyl palmitate, isopropyl stearate, oleyl oleate, hexyl laurate, di-n-butyladipate, caprylic or capric acid ester of saturated $C_{12}$–$C_{18}$ fatty alcohols, esters of branched-chain $C_8$–$C_{12}$ fatty acids with $C_{14}$–$C_{20}$ fatty alcohols, decyl oleate, isooctyl stearate, glycerol trioleate, and i-butyl oleate, (c) from about 1 to about 50% by weight of a monohydric $C_1$–$C_4$ alcohol, (d) from about 0.5 to about 50% by weight of water, (e) an aliphatic straight-chain and/or branched-chain liquid $C_{10}$–$C_{40}$ hydrocarbon or mixtures of such hydrocarbons, present in a amount of up to 90% by weight of component (b), and (f) from about 2 to about 10% of either (i) at least one $C_{10}$–$C_{20}$ fatty alcohol and/or oxoalcohol wherein the fatty alcohol and oxoalcohol contain from 1 to 4 moles of ethylene oxide, (ii) at least one $C_{10}$–$C_{20}$ fatty amine containing from 1 to 4 moles of ethylene oxide, or (iii) a mixture of (i) and (ii).

2. The cleaning composition of claim 1 which also contains from about 3 to about 15% by weight of a monohydric $C_1$–$C_4$ alcohol as component (c) and from about 0.5 to about 40% by weight of water as component (d).

3. The composition of claim 1 wherein the monohydric $C_1$–$C_4$ alcohol is ethyl alcohol, isopropyl alcohol, or a mixture thereof.

4. The cleaning composition of claim 1 wherein component (a) is from about 5 to about 20% by weight of a $C_{10}$–$C_{20}$ fatty alcohol and/or oxoalcohol containing from 5 to 10 mols of ethylene oxide.

5. The cleaning composition of claim 1 wherein component (f) is from about 3 to about 7% by weight $C_{10}$–$C_{20}$ fatty alcohol and/or oxoalcohol containing from 1 to 4 mols of ethylene oxide.

6. The cleaning composition of claim 1 wherein component (f) is from about 3 to about 7% by weight of $C_{10}$–$C_{20}$ fatty amine containing from 1 to 4 mols of ethylene oxide.

7. In the method for the cleaning of heavily soiled fabrics wherein such fabrics are treated with a detergent composition, the improvement comprising the pretreatment of the heavily soiled fabrics with the cleaning composition of claim 1.

8. The method of claim 7 wherein the composition of claim 1 is in liquid form.

9. The method of claim 7 wherein the composition of claim 1 is in sprayable form.

10. The method of claim 7 wherein the composition of claim 1 is in the form of a paste or a gel.

* * * * *